US005950839A

United States Patent [19]

Wedel

[11] Patent Number: 5,950,839

[45] Date of Patent: Sep. 14, 1999

[54] METHOD AND APPARATUS FOR THE SEPARATION OF MANURE AND SAND

[75] Inventor: Andrew W. Wedel, Hollidaysburg, Pa.

[73] Assignee: McLanahan Corporation, Hollidaysburg, Pa.

[21] Appl. No.: 09/032,695

[22] Filed: Feb. 27, 1998

[51] Int. Cl.[6] ..... B03B 5/60; B03B 5/30; B03B 5/28

[52] U.S. Cl. ..... 209/173; 209/172; 209/172.5

[58] Field of Search ..... 209/172, 172.5, 209/173

[56] References Cited

U.S. PATENT DOCUMENTS

| | | | |
|---|---|---|---|
| 2,025,841 | 12/1935 | Young | 209/156 |
| 2,168,942 | 8/1939 | McClave . | |
| 2,368,416 | 1/1945 | Holt | 209/172.5 |
| 2,378,357 | 6/1945 | Erck | 209/172.5 |
| 2,468,005 | 4/1949 | Walker et al. | 209/172.5 |
| 2,491,912 | 12/1949 | Walker | 209/172.5 X |
| 2,530,676 | 11/1950 | Berg et al. | 209/173 |
| 2,559,403 | 7/1951 | Cover | 209/173 |
| 2,764,289 | 9/1956 | Scheid | 209/173 |
| 2,933,187 | 4/1960 | Old et al. . | |
| 3,722,035 | 3/1973 | Hanks | 17/48 |
| 4,250,023 | 2/1981 | Samis et al. | 209/3 |
| 4,297,208 | 10/1981 | Christian . | |
| 4,324,652 | 4/1982 | Hack . | |
| 4,352,732 | 10/1982 | Massicotte | 209/172 X |
| 4,617,113 | 10/1986 | Christophersen . | |
| 4,851,036 | 7/1989 | Anthes et al. . | |
| 4,994,868 | 2/1991 | Jay, Sr. et al. | 209/173 X |
| 5,368,731 | 11/1994 | Pesotini . | |
| 5,628,912 | 5/1997 | Nesseth | 209/768 |
| 5,720,393 | 2/1998 | Wedel et al. . | |

OTHER PUBLICATIONS

Handling and Storage Systems for Sand–Laden Dairy Manure From Free Stall Barns, The Proceedings of the Third International Dairy Housing Conference. Dairy Systems for the 21st Century, 1994. ed. Ray Bucklin.

Analysis of a Batch Aerated Grit Chamber Used to Separate Bedding Sand From Dairy Manure. 1995 ASAE Annual International Meeting Paper No. 95–4705.

*Primary Examiner*—William E. Terrell
*Assistant Examiner*—Joe Dillon, Jr.
*Attorney, Agent, or Firm*—Mary M. Moyne; Ian C. McLeod

[57] ABSTRACT

A method and apparatus (10) for separating a mixture of materials having different sizes and densities is described. The apparatus includes a trough (12), a dispersing and conveying screw (40) and fluid distribution manifolds (26 and 28). The screw has a dispersing portion (50) with paddles (52) which disperse the mixture and a conveying portion (46) with flights (48) which move the first and second materials (152 and 154) up the trough. The fluid distribution manifolds supply both water and air to the trough through fluid orifices (30 and 32). A spray bar (56) is located adjacent the conveying portion of the screw. The mixture is fed into the trough over the fluid orifices and the dispersing portion of the screw. The mixture is dispersed and forms an aqueous suspension (158) with the water. The first and second materials settle out of the aqueous suspension and are conveyed up the trough. The third material (156) remains suspended in the aqueous suspension and flows over the overflow weir (20) and out the lower discharge spout (24). The second material is washed out of the first material by the spray bar and flows back down the trough to be discharged with the third material.

17 Claims, 4 Drawing Sheets

METHOD AND APPARATUS FOR THE SEPARATION OF MANURE AND SAND

BACKGROUND OF THE INVENTION (1) Field of the Invention

The present invention relates to a method and apparatus for the separation of materials having different densities and size in a mixture of the materials to allow for use or disposal of the different materials. In particular, the present invention relates to a method and apparatus for separating sand, which is used for bedding animals, such as cows, from manure having coarse solids in a sand and manure mixture to allow for easy disposal of the manure and coarse solids and reuse of the sand. The present invention also relates to a method and apparatus for use in the mining industry to separate materials having different densities and sizes.

The use of sand as a bedding for animals such as cows has become increasingly more widespread. It has been found that the use of sand as a bedding material for cows has several advantages over the traditionally used chopped straw, sawdust or wood shavings. Some of the benefits are improved udder health, increased cow comfort, cleaner cows, improved traction and lower cost. One drawback to the use of sand is the significant handling and storage problems associated with the resulting manure and sand mixture. Sand in the mixture obstructs the pumps normally used to irrigate the manure mixture. Further, when the mixture is stored in pits, the sand eventually settles out of the mixture and fills the pit thus, requiring excavation of the pit. This method of disposal is costly which can negate the benefits associated with the use of sand. To allow for easy disposal or storage, the manure and sand must be separated. In the past, there was no effective way of separating the manure and coarse solids from the sand.

(2) Description of the Related Art

The related art has shown an assortment of liquid and solid separation systems common to waste water treatment operations as well as the dairy, mining and petroleum refining industries. The publication "Handling and Storage Systems For Sand-Laden Dairy Manure From Free Stall Barns", The Proceedings of the Third International Dairy Housing Conference, Dairy Systems for the 21st Century, 1994 ed. Ray Bucklin, American Society of Agricultural Engineers describes the current methods of handling sand-laden dairy manure and of separating sand from sand-laden dairy manure. The paper also describes the characteristics of a settled sand profile and provides suggestions for long term handling and storage of sand-laden dairy manure. In addition, the publication, "Analysis of a Batch Aerated Grit Chamber Used to Separate Bedding Sand From Dairy Manure" 1995 ASAE Annual International Meeting Paper No. 95-4705 describes several liquid, solid separation techniques and their effectiveness in separating sand from manure in a sand and manure mixture. The inventor is one of the authors in both of the above publications.

Some separation systems such as screening and dissolved air floatation are ineffective for use in separating manure and sand. Dissolved air floatation is ineffective because the minute bubbles are unable to float the large, coarse manure particles to the top of the tank for removal. Screening is ineffective due to the similarities in the particle size distributions of bedding sand and manure. Some other separation systems such as sedimentation and the hydrocyclone are more effective but have disadvantages. Sedimentation is an effective sand separation technique. However, the sand and manure settle out as layers with the manure on top of the sand. The layer of manure on the sand makes removal of the sand difficult without also removing the manure. In addition, dilution ratios in excess of 1:1 (mass parts of water to mass parts of sand laden manure) are required to separate a significant amount of sand from the manure. The separation does not increase for dilution rates greater than 3:1. Hydrocyclones have the potential to be effective sand separators. However, to be effective, the solid feed concentration must remain constant which is difficult to achieve with the manure and sand mixture.

Applications of aeration such as the Pachuca tank and continuous flow aerated grit chambers might also be used to separate sand from manure. However, the prior art does not disclose any such applications using these methods for the stated materials. Pachuca tanks are circular vessels with conical bottoms. Air is introduced at the apex of the conical bottom. The purpose of the conical bottom is to redirect settled solids into the upward flowing fluid so that they may be resuspended. However, because the manure and the sand co-exist in coagulated clumps of a large size, the effectiveness of this technique is reduced. Continuous flow aerated grit chambers consist of either a circular or rectangular concrete tank with air diffusers positioned above the bottom of the tank. The chamber operates as follows: i) influent waste water containing water, organic matter and grit enters the tank; ii) the energy inputted to the water by a continuous air flow creates hydraulic movement of the water; iii) grit settles out while organic material is kept in suspension and carried out of the tank; iv) the accumulated grit is then removed immediately from the tank; and v) effluent containing water and suspended organic matter flows out of the tank. The nature of the energy adsorption into the fluid is crucial to effective grit removal.

The related patent art has also shown various methods and apparatus for separating different materials having different sizes or weights using air and water to provide agitation to separate the materials.

In particular, U.S. Pat. No. 5,720,393 to Wedel et al describes a method and apparatus for the separation of manure and sand in a sand and manure mixture. The apparatus of the first embodiment includes a tank with an upper grate, a lower grate, an air supply tube and a water supply tube. The apparatus of the second embodiment includes a tank having a screened grate, an air supply tube and a water supply tube. The apparatus of the third embodiment includes a tank having an upper portion and a conical lower portion with a grate between the two portions. In operation, in all three embodiments, the chamber of the tank is filled with water. The mixture is then dumped into the chamber to form the aqueous suspension with the water. The flow of air and water, if present, agitates the mixture in the suspension which causes the mixture to break down and the sand to separate from the manure. The sand settles on the floor of the tank while the manure remains suspended in the suspension.

Also, Illustrative are U.S. Pat. Nos. 2,933,187 to Old et al; 4,324,652 to Hack and 4,851,036 to Anthes et al.

Old et al describes an apparatus used for the floatation separation of particles, specifically concrete. The apparatus consists of a tank having an inclined bottom along which is mounted a combination agitator and conveyor. Water and air are introduced vertically into the deep end of the tank and the feeding of the material to be separated is downward into the tank opposite the air and water. In the separation process, the lightweight material floats and is discharged over the wall of the tank at the deep end. The heavier particles are moved along the tank upwardly toward the remote end where they are discharged. A removable, vertically oriented screen extends across the tank, intermediate the ends of the tank and prevents the lightweight material from moving with the heavy material toward the shallow end of the tank.

Hack describes a method and apparatus for scrubbing crude oil (bitumen) from tar-sands. The apparatus includes a pair of counter-rotating screw conveyors which tumble the tar-sand so as to rub the grains together and scrub the oil from the sand particles while at the same time moving the progressively cleaner sand toward the discharge end. An air-aspirating venturi underneath the sand lying in the bottom of the cell allows for simultaneously flushing and aerating the sand being tumbled to push the oil particles through the sand and carrying them to the surface.

Anthes et al describes a process and apparatus for separating relatively floatable particulate material from a mixture also having relatively non-floatable, particulate material. The apparatus includes a column with at least one baffle to promote turbulence within the column. Air is introduced into the column below the point of introduction of the mixture to be separated. Water is also added to the column. The rates of introduction of the mixture, air and water and the number and configuration of the baffles must be such as to create a substantial amount of turbulence in the column to keep the relatively floatable particulate matter at the upper portion of the column.

Also of interest is U.S. Pat. No. 4,617,113 to Christophersen et al which shows a floatation separating system only of minimal interest are U.S. Pat. Nos. 2,168,942 to McClave; 4,297,208 to Christian and 5,368,731 to Pesotini.

There remains a need for an apparatus which easily and quickly separates the materials having different densities and sizes in a mixture of the materials to allow for use or disposal of the different materials.

OBJECTS

It is therefore an object of the present invention to provide an apparatus and method for separating materials having different densities and sizes in a mixture of the materials to allow for use or disposal of the different materials. Further, it is an object of the present invention to provide an apparatus for separating materials having different densities and sizes which uses air and water to disperse the mixture to separate the mixture into the different materials. Still further, it is an object of the present invention to provide a method and apparatus for separating materials having different densities and sizes in a mixture of the materials where the materials having the greater density settle out of the aqueous suspension for removal and the materials having the lesser densities are suspended in the aqueous suspension for removal. Further, it is an object of the present invention to provide a method and apparatus for separating materials having different densities and sizes in a mixture of materials where the coarse and less dense material is washed out of and away from the more dense material. Further still, it is an object of the present invention to provide a method and apparatus for separating sand from manure in a manure and sand mixture which provides reusable sand and an easily handlable manure suspension. Still further, it is an object of the present invention to provide an apparatus which uses air and water to agitate an aqueous suspension containing the manure and sand mixture to separate sand from manure. Further still, it is an object of the present invention to provide an apparatus which uses rotating paddles to help disperse the mixture. These and other objects will become increasingly apparent by reference to the following drawings and the description.

DETAILED DESCRIPTION OF THE PREFERRED EMBODIMENT

Figure 1:
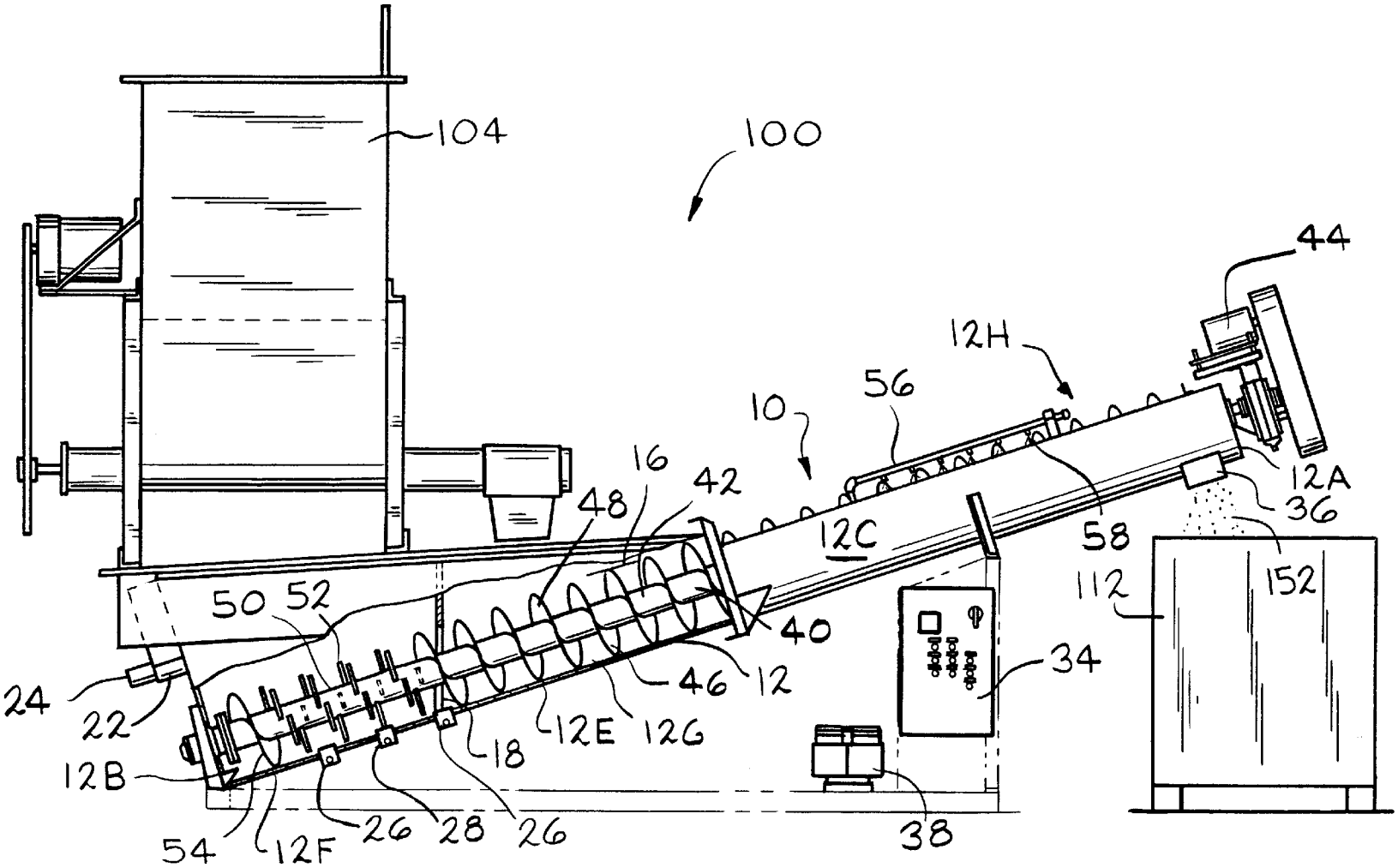
FIG. 1 is a right side view of the separation system 100 of the present invention.

The present invention relates to an improved apparatus for separating a first material from a second and third material in a mixture of the materials wherein the second material is more coarse than the third material and the second and third materials are less dense than the first material, the apparatus includes a container having a first end and a second end with a dispersing section adjacent the first end, a fluid supply means for introducing fluids into the dispersing section of the container wherein the fluids are air and water, a dispersing means mounted in the dispersing section of the container to disperse the mixture in the container, feed means for feeding the mixture into the container adjacent the dispersing means on a side opposite the fluid supply means, first removal means provided in the container for moving the first and second materials from the dispersing section of the container toward the second end of the container, second removal means in the container between the dispersing section and the second end for removing the second material from the first material adjacent the first removal means, a first discharge means adjacent the second end of the container for removing the first material from the container and a second discharge means adjacent the first end of the container for removing the third material and the fluid from the container, the improvement which comprises: a third discharge means adjacent the first end of the container for removing the second material from the container.

Further, the present invention relates to an improved apparatus for separating a first material from a second and third material in a mixture of the materials wherein the second material is more coarse than the third material and the second and third materials are less dense than the first material, the apparatus including an inclined container having a bottom and first and second sides between spaced apart first and second ends with the first end being lower than the second end wherein the container adjacent the first end can contain an aqueous suspension and wherein the third material overflows from the first end, a screw means for dispersing the mixture and conveying the first and second materials mounted between the ends of the container in closely spaced relation to the second side and the bottom of the container wherein the screw means comprises a shaft and flights along the shaft between the ends of the container, the screw means being rotatable to convey the first and second materials away from the first end of the container, a fluid supply means for introducing fluids into the container intermediate the ends wherein the fluids include air and water, feed means for feeding the mixture into the container above the fluid supply means opposite the bottom of the container, drive means for rotating the shaft of the screw means, and spray means mounted along a segment of the container above a water level in the container for moving the second material away from the first material being conveyed by the screw means toward the second end of the container, the improvement which comprises: a side wall mounted in the container adjacent the first side of the container such as to form a side section in the container wherein the second material is moved into the side section of the container.

Still further, the present invention relates to an improved method for separating a first material from a second and third material in a mixture of the materials wherein the second material is more coarse than the third material and the second and third materials are less dense than the first material, the method including the steps of providing a container having a first end and a second end with a dispersing section adjacent the first end, a fluid supply means for introducing fluids into the dispersing section of the container wherein the fluids are air and water, dispersing means mounted in the dispersing section of the container to disperse the mixture in the container, feed means for feeding the mixture into the container adjacent the dispersing means on a side opposite the fluid supply means, first removal means provided in the container for moving the first and second materials from the dispersing section of the container toward the second end of the container, a first discharge means adjacent the second end of the container for removing the first material from the container, a second discharge means adjacent the first end of the container for removing the second and third materials and the fluid from the container, and a second removal means in the container between the dispersing section and the second end for removing the second material from the first material along the first removal means, feeding the mixture into the dispersing section of container containing an aqueous suspension adjacent the dispersing means, removing the first and second materials from the dispersing section of the container toward the second end of the container, removing the first material from the container by the first discharge means and removing the third material from the container through the second discharge means, the improvement which comprises the steps of: providing a third discharge means adjacent the first end of the container for removing the second material from the container; removing the second material from the first material and moving the second material toward the first end of the container; and removing the second material from the container through the third discharge means.

Finally, the present invention relates to an improved method for separating a first material from a second and third material in a mixture of the materials wherein the second material is more coarse than the third material and the second and third materials are less dense than the first material, including the steps of providing an inclined container having a bottom and first and second sides between spaced apart first and second ends with the first end being lower than the second end wherein the container adjacent the first end can contain an aqueous suspension and wherein the third material overflows from the first end, with a screw means for dispersing the mixture and conveying the first and second materials mounted between the ends of the container in closely spaced relation to the second side and the bottom of the container wherein the screw means comprises a shaft and screw flights along the shaft between the ends of the container, the screw means being rotatable to convey the first and second materials away from the first end of the container, including a fluid supply means for introducing fluids into the container intermediate the ends wherein the fluids include air and water, feed means for feeding the mixture into the container above the fluid supply means opposite the bottom of the container, a drive means for rotating the shaft of the screw means, and a spray means on a segment of the container above a water level in the container for washing the second material away from the first material being conveyed by the screw means toward the first end of the container, introducing the mixture of materials into the feed means and feeding the mixture into the container containing an aqueous suspension, removing the first and second materials through the screw means by conveying the first and second materials away from first end of the container, discharging the first material from the container adjacent the second end of the container and discharging the third material from the container adjacent the first end of the container, the improvement which comprises the steps of: providing a side wall mounted in the container adjacent the first side of the container such as to form a side section in the container and a first discharge means adjacent the first end of the container; removing the second material from the first material by the spray means and moving the second material into the side section of the container; and removing the second material from the side section of the container through the first discharge means.

FIG. 1 shows the preferred separation system 100 which uses the separating apparatus of the present invention. The system 100 may include a hopper 104, the separating apparatus 10, a lower collection bin (not shown) and an upper collection bin 112. The mixture is preferably automatically fed into the separation apparatus 10 by a feed bin or hopper 104 (FIG. 1). The hopper 104 is preferably similar to those well known in the art. The hopper 104 is positioned so that the feed opening (not shown) is directly over the fluid orifices 30 and 32 in the floor 12E of the trough 12 (to be described in detail hereinafter). The hopper 104 preferably allows only a limited amount of the mixture to be fed into the trough 12 of the separation apparatus 10 at one time. The metering of the mixture into the separation apparatus 10 allows the mixture to be more efficiently and easily separated.

Figure 3:
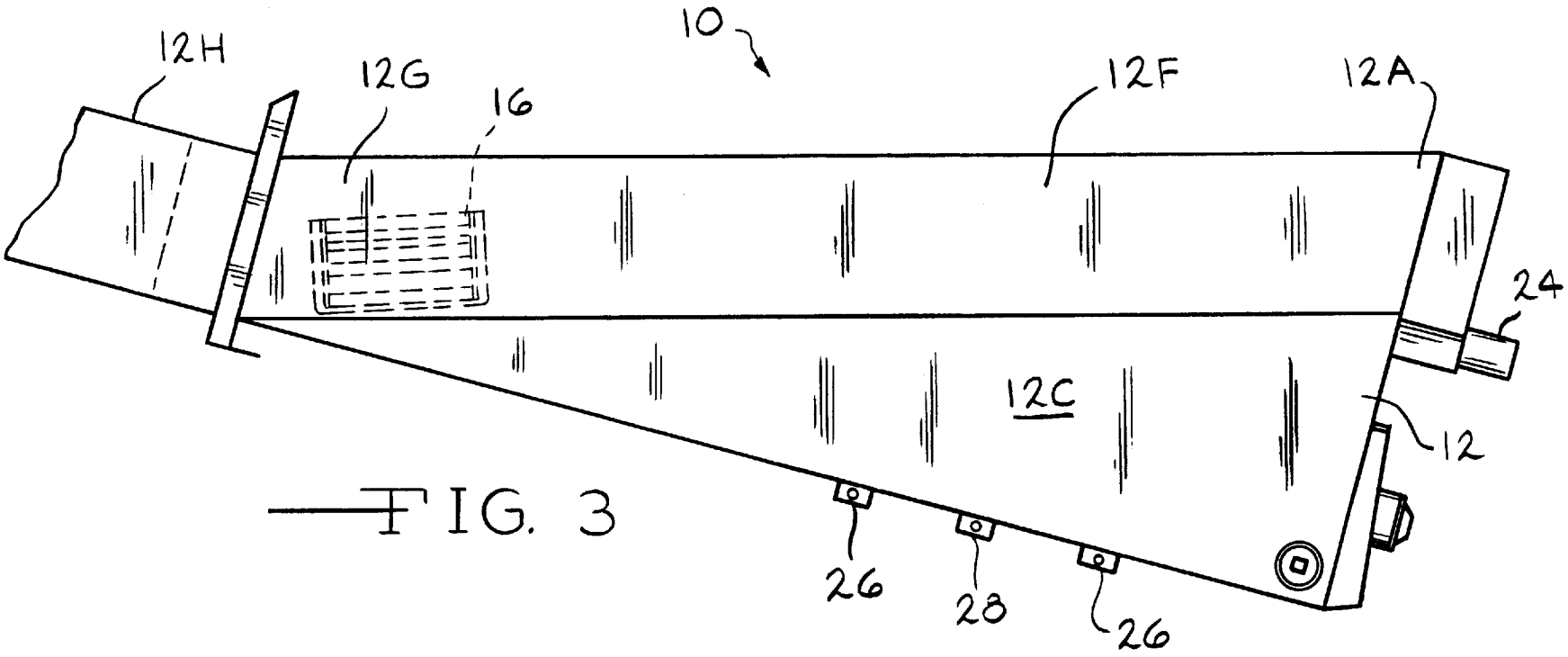
FIG. 3 is a schematic left side view of the lower portion 12F of the trough 12 showing the side weir 16 in phantom.
Figure 5:
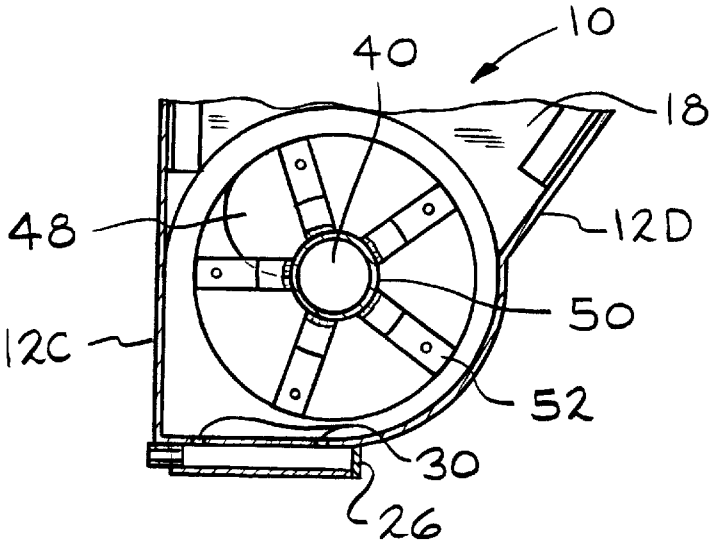
FIG. 5 is a cross-sectional view along line 5—5 of FIG. 4 without the materials 152, 154 and 156.

The separation apparatus 10 includes a trough 12, fluid distribution manifolds 26 and 28, a conveying and dispersing screw 40 and a spray bar 56. The trough 12 preferably has a rectangular shape with an upper end 12A, a lower end 12B, opposed first and second sides 12C and 12D and a floor 12E extending therebetween. The trough 12 is preferably divided into lower, middle and upper portions 12F, 12G and 12H. The top of the trough 12 is preferably open along the entire length of the trough 12. The trough 12 is inclined upward such that the lower end 12B of the trough 12 is lower than the upper end 12A of the trough 12. The trough 12 preferably angles upward at a slope of between 1° and 45° with about 18° being preferred. In the lower portion 12F of the trough 12, the first side 12C of the trough 12 is perpendicular to the floor 12E. The second side 12D of the trough 12 has a bottom section with an arcuate shape and an upper section which angles outward away from the first side 12C of the trough 12 (FIG. 5). The slope of the upper section of the second side 12D is such as to control the turbulence and water velocity in the lower portion 12F of the trough 12. The shape of the lower portion 12F of the trough 12 allows the first and second materials 152 and 154 to be retained in the trough 12 without allowing the third material 156 to settle out of the aqueous suspension 158. A side wall 12I extends the entire length of the lower and middle portions 12F and 12G of the trough 12. The side wall 12I is spaced parallel to the first side 12C of the trough 12 on a side opposite the second side 12D of the trough 12. Preferably, the side wall 12I is spaced above the conveying and dispersing screw 40. A side channel 14 is formed in the trough 12 along the lower and middle portions 12F and 12G between the side wall 12I and the first side 12C of the trough 12. Thus, the top portion of the lower and middle portions 12F and 12G of the trough 12 are divided into the side channel 14 and main sections 15 and 17. An adjustable side discharge weir 16 is located on the first wall 12C in the middle portion 12G of the trough 12 adjacent the upper portion 12H (FIG. 3). The side discharge weir 16 preferably has an opening size of 18.0 inches (45.7 cm). The main sections 15 and 17 of the lower and middle portions 12F and 12G of the trough 12 are separated by a baffle plate 18 which extends between the first side 12C and the second side 12D of the trough 12. The bottom edge of the baffle plate 18 has an arcuate shape cut out such as to accommodate the flights 48 of the conveying and dispersing screw 40 (FIG. 5) (to be described in detail hereinafter).

Figure 2:
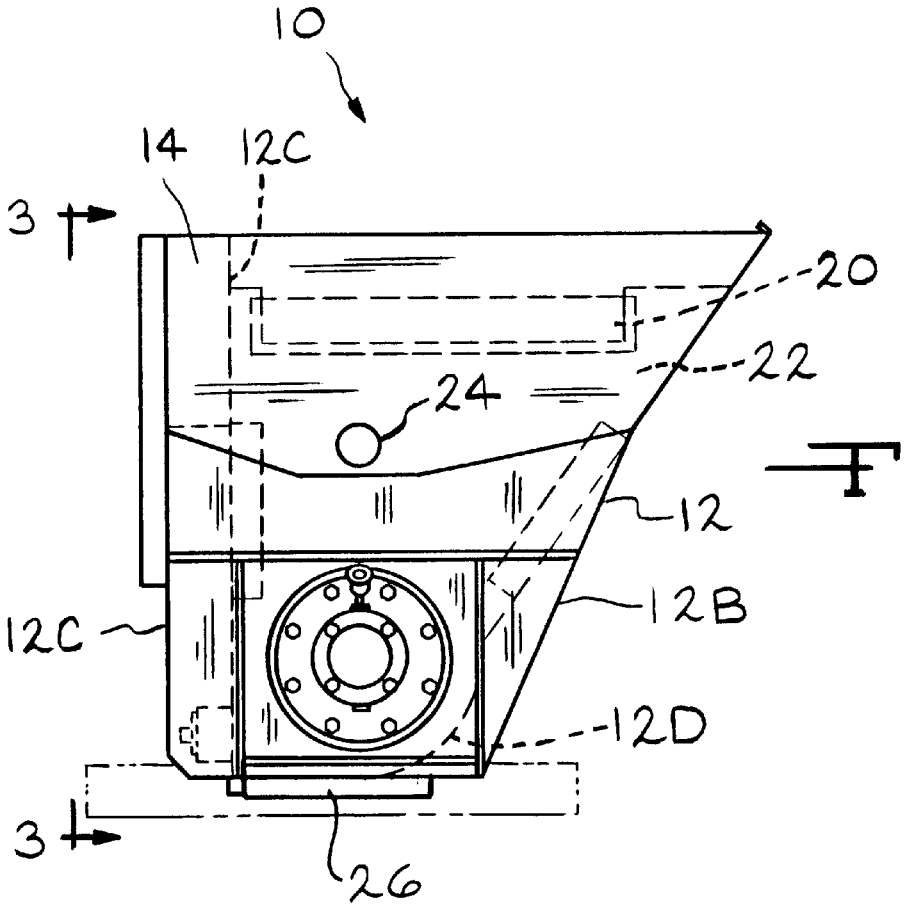
FIG. 2 is an end view of the trough 12 showing the lower discharge spout 24 and the overflow weir 20 in phantom.

An overflow weir 20 is located at the lower end 12B of the trough 12 and extends across the entire width of the trough 12 including main sections 15 and 17 (FIG. 2). The height of the overflow weir 20 is preferably adjustable to allow variations in the water level and to vary the discharge rate of the fluid and materials 154 and 156. An overflow channel 22 is located behind the overflow weir 20 on the side opposite the trough 12 and extends at least the entire width of the trough 12. The overflow channel 22 guides the second and third materials 154 and 156 and fluid into a lower discharge spout 24. A lower collection bin (not shown) is positioned below the lower discharge spout 24 to collect the removed fluid and second and third materials 154 and 156.

In the upper portion 12H of the trough 12, the sides 12C and 12D of the trough 12 are perpendicular to the floor 12E of the trough 12. The floor 12E of the trough 12 adjacent the upper end 12A is provided with an upper discharge opening 36. The opening 36 is positioned over an upper collection bin 112. In an alternate embodiment (not shown) the floor 12E of the trough 12 along the entire length of the upper portion 12H of the trough 12 forms an arcuate shape with the lower, adjacent portion of the second side 12D of the trough 12. Preferably, the arcuate angle of the floor 12E and side 12D is dependent on the radius of the flights 48 on the conveying portion 46 of the conveying and dispersing screw 40. The trough 12 as described above with the overflow weir 20, the lower discharge spout 24, the upper discharge opening 36 and the conveying and dispersing screw 40 is preferably similar to the fine material screw classifiers manufactured by McLanahan Corporation of Hollidaysburg, Pa.

In a preferred embodiment, the trough 12 has a length of 264.0 inches (670.6 cm) between the ends 12A and 12B with the upper portion 12H having a length of 132.0 inches (335.3 cm). In the upper portion 12H, the trough 12 has a width of 30.0 inches (76.2 cm). In the lower portion 12F, the main section 15 has a width of 22.0 inches (55.9 cm) and the side channel 14 has a width of 6.0 inches (15.2 cm). The width of the upper portion 12H of the trough 12 is preferably wider than the lower and middle portions 12F and 12G of the trough 12 with the side channel 14 to allow the second material 154 to flow toward the side discharge weir 16. The sides 12C and 12D of the trough 12 at the lower end 12B have a height of about 51.0 inches (129.6 cm) such that the trough 12 is deepest at the lower end 12B of the trough 12. The sides 12C and 12D and floor 12E of the trough 12 are preferably constructed as separate pieces; however, the trough 12 may also be constructed as a unitary piece. The trough 12 is preferably constructed of steel; however, any similar durable material can be used.

Several fluid distribution manifolds 26 and 28 having fluid orifices 30 and 32 are located below the floor 12E of the trough 12 in the main section 15 of the lower portion 12F of the trough 12. The fluid orifices 30 and 32 are located in the floor 12E of the trough 12 over the fluid distribution manifolds 26 and 28 and allow the fluid distribution manifolds 26 and 28 to be in fluid communication with the main section 15 of the trough 12 (FIG. 7). The orifices 30 and 32 must be located below the water line in the lower portion 12F of the trough 12. In a preferred embodiment, there are three (3) fluid distribution manifolds 26 and 28 each having two (2) orifices 30 and 32. The orifices 30 and 32 preferably have a diameter of 0.5 inches (1.3 cm). In the preferred embodiment, two of the fluid distribution manifolds 26 provide water and one of the manifolds 28 provides air. Preferably, the air manifold 28 is spaced between the water manifolds 26. The number and placement of the fluid distribution manifolds 26 and 28 and the orifices 30 and 32 can be varied. However, the position of the feed opening of the hopper 104 should be varied accordingly such that the mixture is always fed directly over the orifices 30 and 32. The air manifold 28 is connected by air hoses (not shown) to an air supply (not shown). The air supply is preferably a compressor 38; however, any type of air supply may be used. The air supply provides 1 to 20 CFM of air to the manifold 28 with a pressure of 1 to 100 PSI. Preferably, the minimum pressure is that necessary to overcome the static head of the water in the main section 15 of the trough 12 plus the frictional losses in the inlet. The water manifolds 26 are preferably connected to a water supply by water hoses (not shown). In a preferred embodiment, the water supply is of any type such as a direct hook up to the water supply for a building (not shown) housing the apparatus 10 or to a pond (not shown). In a preferred embodiment, the water supply provides 1 to 30 gallon/minute of feed to the water inlets. The water and air manifolds 26 and 28 are preferably controlled by a control module 34 which allows the user to vary the amount of water and air entering the fluid distribution manifolds 26 and 28 and the lower portion 12F of the trough 12 (FIG. 1).

A conveying and dispersing screw 40 is rotatably located between the ends 12A and 12B of the trough 12. The conveying and dispersing screw 40 includes a screw conveying portion 46 and a dispersing portion 50 which share a common shaft 42. The shaft 42 is rotatably connected at the upper and lower ends 12A and 12B of the trough 12. In the lower and middle portions 12F and 12G of the trough 12, the screw 40 is evenly spaced between the first and second sides 12C and 12D of the trough 12. In the upper portion of the trough 12, the screw 40 is spaced between the sides 12C and 12D of the trough 12 such as to be closer to the second side 12D of the trough 12. A drive motor 44 is connected to the shaft 42 at the upper end 12A of the trough 12 to rotate the conveying and dispersing screw 40. The drive motor 44 is preferably a 2 to 25 hp motor.

The conveying portion 46 of the screw 40 extends the entire length of the middle and upper portions 12G and 12H of the trough 12 and slightly into the lower portion 12F of the trough 12. The conveying portion 46 extends from the upper end 12A of the trough 12 to slightly before the fluid distribution manifolds 26 and 28. The conveying portion 46 has screw flights 48 which are mounted on the shaft 42 and extend the entire length of the conveying portion 46. The flights 48 are of such a size and the conveying portion 46 is positioned such that the flights 48 are closely adjacent the floor 12E of the trough 12 (FIG. 1). The flights 48 are spaced apart from the floor 12E and second side 12D of the trough 12 a distance of between 1 and 4 times the diameter of the largest particle of the first material 152 to be removed by the screw conveying portion 46 of the trough 12 so that two particles of the first material 152 can not get caught between the flights 48 and the trough 12. This helps prevent the conveying and dispersing screw 40 from jamming. The diameter of the largest particle of the first material 152 is preferably about 0.5 inches (1.3 cm) and the flights 48 are spaced a distance of 0.5 to 2.0 inches (1.3 to 5.1 cm) from the floor 12E and side 12D of the trough 12. Preferably, the flights 48 extend slightly above the sides 12C and 12D of the trough 12 in the upper portion 12H of the trough 12 but are below the sides 12C and 12D in the middle and lower portions 12G and 12F of the trough 12. The screw 40 with the flights 48 preferably has a diameter between the range of 10.0 inches (25.4 cm) and 72.0 inches (182.9 cm). The screw 40 preferably has a half pitch which corresponds to a spacing between the flights 48 of half the diameter of the flights 40.

Figure 4:
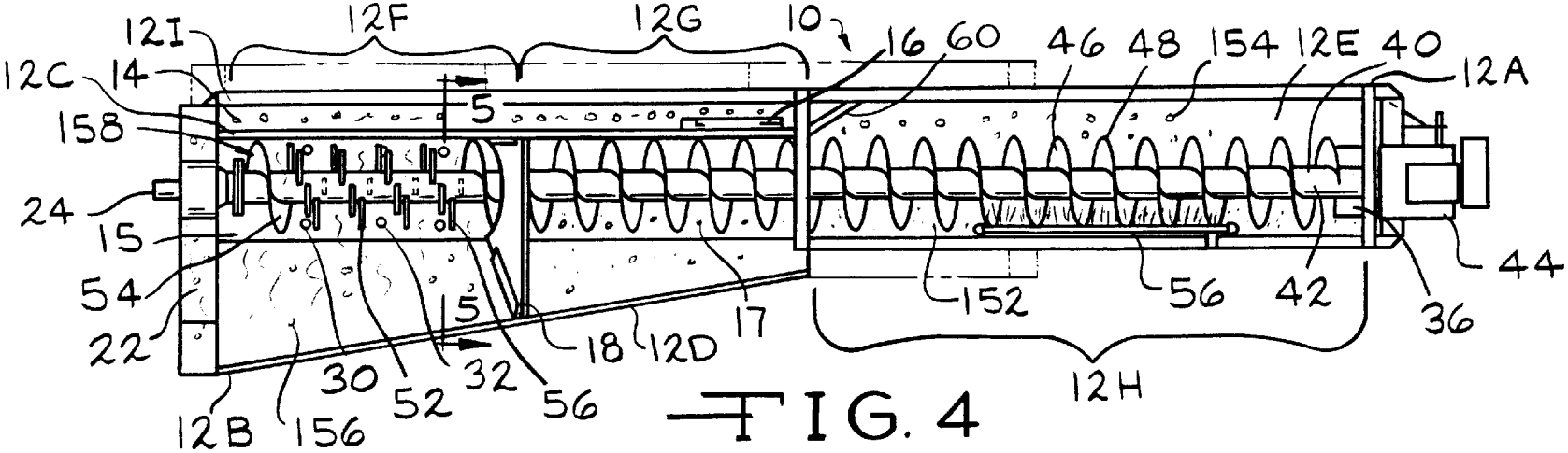
FIG. 4 is a top view of the trough 12 showing the conveying and dispersing screw 40 and the movement of the materials 152, 154 and 156 in diagrammatic view.

In a preferred embodiment, the dispersing portion 50 of the screw 40 extends from the lower end 12B of the trough 12 to the baffle plate 18 which is positioned slightly beyond the orifices 30 and 32 of the fluid distribution manifolds 26 and 28 toward the upper end 12A of the trough 12. The dispersing portion 50 includes paddles 52 mounted on the shaft 42. The paddles 52 extend outward a distance from center line of 5.0 inches to 36.0 inches (12.7 cm to 91.4 cm). The paddles 52 are preferably spaced 5.0 inches (12.7 cm) apart center to center along the shaft 42 and are spaced 90° apart in a spiral around the shaft 42. The paddles 52 are preferably removable and reversible such that the paddles 52 can be removed and reversed to be used again. The paddles 52 are preferably similar to those well known in the art. A flight 54 similar to the screw flights 48 of the conveying portion 46 is positioned on the end of the shaft 42 adjacent the lower end 12B of the trough 12 (FIG. 4). The flight 54 acts to prevent the first material 152 from building up and packing around the bearing (not shown) and shaft 42. The flight 54 moves the first and second materials 152 and 154 away from the bearing similar to the flights 48 of the screw conveying portion 46.

In the preferred embodiment, a spray bar 56 is mounted on the second side 12D of the upper portion 12H of the trough 12. The spray bar 56 is positioned parallel to and above the flights 48 of the conveying portion 46 of the conveying and dispersing screw 40. The orifices 58 of the spray bar 56 are located on the inner side of the spray bar 56 and are angled downward such that the spray bar 56 sprays water on the flights 48 of the conveying portion 46 adjacent the second side 12D of the trough 12 (FIG. 1). The orifices 58 are positioned at approximately a 45° angle with the second side 12D of the trough 12 so as to move the removed second material 154 toward the first side 12C of the trough 12. In a preferred embodiment, the spray bar 56 is connected to the same water supply as the water distribution manifold 26. The spray bar 56 preferably has a length such as to extend 75% of the length of the conveying portion 46 of the dispersing and conveying screw 40. In a preferred embodiment, the spray bar 56 has a length of about 50.0 inches (127.0 cm) and an inner diameter of 1.0 inch (2.5 cm). The orifices 58 have a diameter of 0.5 inches (1.3 cm) and are spaced 7.5 inches (19.1 cm) apart. The orifices 58 of the spray bar 56 may be equipped with spray nozzles (not shown) for improved water distribution. However, any well known means of evenly distributing the water may be used. Preferably, the majority of the second material 154 and other organic solids have been washed from the first material 152 before the first material 152 reaches the upper end of the spray bar 56. The spray bar 56 preferably has a water output of 4 gallon/minute preferably 1 to 10 gallon/ton per hour of manure.

An angled guide partition 60 is located on the first side 12C in the upper portion 12H of the trough 12 adjacent the middle portion 12G of the trough 12. The partition 60 extends inward such that the width of the upper portion 12H of the trough 12 adjacent the middle section 12G is equal to the width of the main section 17 of the middle portion 12G. The angled partition 60 acts to guide the flow of second material 154 toward the main section 17 of the middle portion 12G of the trough 12.

IN USE

The system 100 is used to separate materials 152, 154 and 156 having different densities, size or coarseness which are mixed together in a mixture. The mixture is separated into first, second and third materials 152, 154 and 156 with the second and third materials 154 and 156 being less dense than the first material 152 and the second material 154 being more coarse than third material 156. The second material 154 typically has the same density as the third material 156. However, due to its larger size, the second material 154 preferably has the same settling characteristics as the first material 152.

To use the separation system 100, the system 100 is first configured such that the feed opening of the hopper 104 is directly above the fluid orifices 30 and 32, the upper collection bin 112 is beneath the upper discharge opening 36 and the lower collection bin is beneath the lower discharge spout 24. The fluid distribution manifolds 26 and 28 and the spray bar 56 are preferably activated prior to feeding the mixture into the trough 12. However, it is possible to activate the spray bar 56 after the apparatus 10 has begun operating. The mixture is fed into the main section 15 of the lower portion 12F of the trough 12. In a preferred embodiment, the mixture is fed into the trough 12 when the water level in the lower portion 12F of the trough 12 is level with the overflow weir 20 at the lower end 12B of the trough 12. The baffle plate 18 dissipates turbulence in the lower portion 12F. The mixture is preferably metered from the hopper 104 into the trough 12. The mixture drops into the trough 12 above the fluid distribution orifices 30 and 32 and the paddles 52 of the dispersing portion 50 of the conveying and dispersing screw 40. The rotating paddles 52 contact the mixture and act to disperse the mixture. The contact of the rotating paddles 52 with the water in the lower portion 12F of the trough 12 also acts to further disperse the mixture which has entered the water in the lower portion 12F of the trough 12. In addition, the air and water introduced through the fluid distribution orifices 30 and 32 also helps to disperse the mixture. As the mixture becomes dispersed, the mixture and the water in the lower portion 12F of the trough 12 form an aqueous suspension 158, the upward momentum imparted by the air and water introduced through the fluid distribution orifices 30 and 32 into the aqueous suspension 158 causes the third material 156 to become suspended in the aqueous suspension 158. The use of air along with the water to disperse the mixture creates turbulence in the aqueous suspension 158 and decreases the total amount of water needed in the separation process. Therefore, the second and third materials 154 and 156 are less diluted and have less volume when they flow out of the lower discharge spout 24 which means that less volume is needed for storage of the separated second and third materials 154 and 156. Using less water also reduces the cost of operating the system 100.

As the separation process continues, the level of the aqueous suspension 158 in the lower portion 12F of the trough 12 remains constant as the aqueous suspension 158 including the third material 156 and the water continuously flows over the overflow weir 20 at the lower end 12B of the trough 12. The third material 156 flows into the overflow channel 22 and out through the lower discharge spout 24 into the lower collection bin. At the same time, the first material 152 which has a greater density than the second and third materials 154 and 156 and the second material 154 which has a greater size than the third material 156 settle out of the aqueous suspension 158 onto the floor 12E of the trough 12 due to gravity. The first and second materials 152 and 154 which have settled on the floor 12E of the trough 12 are moved upward by both the paddles 52 of the dispersing portion 50 and the screw flights 48 of the conveying portion 46 of the conveying and dispersing screw 40 depending upon the location of the materials 152 and 156 in the trough 12. The paddles 52 of the dispersing portion 50 move the settled first and second materials 152 and 154 toward the flights 48 of the conveying portion 46 of the conveying and dispersing screw 40. As the first and second materials 152 and 154 are moved upward out of the aqueous suspension 158 and into the upper portion 12H of the trough 12, the close proximity of the flights 48 of the screw conveying portion 46 with the floor 12E of the trough 12 prevents the first and second materials 152 and 154 from sliding back into the aqueous suspension 158. As the first and second materials 152 and 154 are moved upward by the screw conveying portion 46 of the conveying and dispersing screw 40, the water from the spray bar 56 acts to remove the second material 154 as well as additional amounts of the third material 156 from the first material 152. The size of the second material 154 as well as the fact that the second material 154 is less dense than the first material 152 allows the second material 154 to be washed out of and away from the first material 152. The removed second material 154 and any remaining third material 156 flows back down the trough 12 between the screw 40 and the first side 12C of the trough 12. The flow of water down the trough 12 past the flights 48 also creates a syphoning effect which acts to remove additional water from the first material 152 as the first material 152 is conveyed up the trough 12. The inclined angle of the trough 12 also aids in allowing the water in the first material 152 to drain back toward the lower end 12B of the trough 12.

As the large sized coarse second material 154 is washed downward, the second material 154 is diverted by the partition 60 into the middle portion 12G of the trough 12 and over the side discharge weir 16 in the side wall 12I into the side channel 14 extending along the middle and lower portions 12G and 12F of the trough 12. The baffle plate 18 prevents the coarse second material 154 from continuously recirculating around the trough 12. The overflow weir 20 changes the geometry of the lower portion 12F of the trough 12 which can be adjusted to create a faster flow rate of the water over the overflow weir 20. As the separation process continues, the level of the aqueous suspension 158 in the main sections 15 and 17 and in the side channel 14 of the trough 12 remains constant. The suspended third material 156 flows over the overflow weir 20 at the lower end 12B of the trough 12 and into the overflow channel 22. The second material 154 is recombined with the third material 156 in the overflow channel 22 and flows out of the lower discharge spout 24 and into the lower collection bin. The separated, washed and relatively dewatered first material 152 is conveyed up the trough 12 through the upper discharge opening 36 and into the upper collection bin 112.

In a preferred embodiment, the mixture contains sand as the first material 152. The second material 154 is preferably the coarse organic matter fraction in animal manure such as undigested corn. The third material 156 is mostly comprised of fine organic solids in animal manure and water; however, the third material 156 can also contain silt or clay or other material less dense than sand. It is understood that the system 100 can be used to separate a variety of different mixtures having materials of different densities and sizes. For instance, in the aggregate industry, the system 100 could be used to separate sand from silt and clay.

The first material 152 which is removed preferably contains less than 2.0% organic matter (dry basis). Field studies have indicated that sand bedding containing less than 2.0% organic matter (dry basis) is suitable for rebedding. The second material 154, third material 156 and water which is discharged through the lower discharge spout 24 contains less than 2.0% sand. The sand fraction remaining is extremely fine and can be pumped with little difficulty or resultant wear to processing equipment. The second material 154, third material 156 and water which is collected in the lower collection bin may be used to fertilize and irrigate using conventional well known methods and apparatuses for spreading fertilizer.

The system 100 preferably operates as a continuous process and separates 12,000 lbs. of mixture per hour. This would handle about 50 to 70 cows per hour. For instance, for a 500 cow herd, the system 100 would operate for approximately 10 hours/day. The average number of cows per herd is less than 100. Large farms may have over 2,000 cows. The amount of mixture able to be handled by the apparatus 10 will depend on the size of the container pool volume and the screw diameter. Overall, the system 100 removes about 95% of the sand from the mixture. It is understood that the apparatus 10 and system 100 can be made in a variety of different sizes depending upon the amount of mixture 100 needed to be separated in a given amount of time.

It is intended that the foregoing description be only illustrative of the present invention and that the present invention be limited only by the hereinafter appended claims.

I claim:

1. An improved apparatus for separating a first material from a second and third material in a mixture of the materials wherein the second material is more coarse than the third material and the second and third materials are less dense than the first material, the apparatus including an inclined container having a bottom and first and second sides between spaced apart first and second ends with the first end being lower than the second end wherein the container is configured to contain an aqueous suspension adjacent the first end and wherein the third material overflows from the first end, a screw means for dispersing the mixture and conveying the first and second materials mounted between the ends of the container in closely spaced relation to the second side and the bottom of the container wherein the screw means comprises a shaft with conveying flights and dispersing members along the shaft between the ends of the container, the shaft of the screw means being rotatable to rotate the conveying members to convey the first and second materials away from the first end of the container and to rotate the dispersing members to disperse and separate the mixture, a fluid supply means for introducing fluids into the container intermediate the ends to assist in separating the mixture wherein the fluids include air and water, feed means for feeding the mixture into the container above the fluid supply means opposite the bottom of the container, drive means for rotating the shaft of the screw means, and spray means mounted along a segment of the container above a water level in the container for moving the second material away from the first material being conveyed by the screw means toward the second end of the container, the improvement which comprises:

a side wall mounted in the container adjacent the first side of the container such as to form a side section in the container wherein the second material is moved by the spray means and gravity into the side section of the container.

2. The apparatus of claim 1 wherein a discharge means is located adjacent the first end of the container for guiding the second and third materials and the fluid which overflows the first end of the container for collection.

3. The apparatus of claim 1 wherein the first material is sand and the second material is a coarse solid fraction in animal manure and the third material is animal manure which includes water.

4. The apparatus of claim 1 wherein a first weir is located in the first side of the container such as to allow the second material to flow into the side section.

5. The apparatus of claim 1 wherein a first overflow means is located at the first end of the container and extends between the sides of the container and wherein a second overflow means extends between the side wall and the first side of the container for allowing a combination of the overflow of the second and third materials and fluid into a channel.

6. The apparatus of claim 1 wherein the fluid supply means is positioned below the dispersing members adjacent the bottom of the container for introducing fluids into the container below the dispersing members to assist in separating the mixture.

7. The apparatus of claim 1 wherein the rotating shaft has a first portion adjacent the first end of the container and a second portion adjacent the second end of the container and wherein the first portion of the rotating shaft is provided with the dispersing members for dispersing and separating the mixture adjacent the first end of the container.

8. The apparatus of claim 7 wherein the second portion of the rotating shaft is provided with the conveying flights for conveying the first and second materials away from the first end of the container.

9. The apparatus of claim 1 wherein the second material is removed from the first material by the spray means into the side section and toward the first end of the container.

10. The apparatus of claim 9 wherein the spray means sprays water onto the first and second materials to remove the second material and allow the second material to flow toward the first end of the container.

11. An improved method for separating a first material from a second and third material in a mixture of the materials wherein the second material is more coarse than the third material and the second and third materials are less dense than the first material, including the steps of providing an inclined container having a bottom and first and second sides between spaced apart first and second ends with the first end being lower than the second end wherein the container is configured to contain an aqueous suspension adjacent the first end and wherein the third material overflows from the first end, with a screw means for dispersing the mixture and conveying the first and second materials mounted between the ends of the container in closely spaced relation to the second side and the bottom of the container wherein the screw means comprises a shaft with conveying flights and dispersing members along the shaft between the ends of the container, the shaft of the screw means being rotatable to rotate the conveying flights to convey the first and second materials away from the first end of the container and to rotate the dispersing members to separate and disperse the mixture, including a fluid supply means for introducing fluids into the container intermediate the ends to assist in separating the mixture wherein the fluids include air and water, feed means for feeding the mixture into the container above the fluid supply means opposite the bottom of the container, a drive means for rotating the shaft of the screw means, and a spray means on a segment of the container above a water level in the container for washing the second material away from the first material being conveyed by the screw means toward the first end of the container, introducing the mixture of materials into the feed means and feeding the mixture into the container containing an aqueous suspension, removing the first and second materials through the screw means by conveying the first and second materials away from the first end of the container, discharging the first material from the container adjacent the second end of the container and discharging the third material from the container adjacent the first end of the container, the improvement which comprises the steps of:

(a) providing a side wall mounted in the container adjacent the first side of the container such as to form a side section in the container and a first discharge means adjacent the first end of the container;

(b) removing the second material from the first material by the spray means and moving the second material into the side section of the container; and (c) removing the second material from the side section of the container through the first discharge means.

12. The method of claim 11 wherein after feeding the mixture into the container, the shaft having the dispersing members is activated and the fluid supply means is activated to agitate the aqueous suspension to disperse the mixture in the aqueous system and to separate the materials of the mixture.

13. The apparatus of claim 11 wherein a first overflow means is located at the first end of the container and extends between the sides of the container and wherein a second overflow means extends between the side wall and the first side of the container for allowing the overflow of the second and third materials and fluid into a channel and wherein the second and third materials and fluid are removed through a second discharge means.

14. The apparatus of claim 11 wherein the third material overflows into a channel and the first discharge means is in fluid communication with the channel and wherein the second and third materials and fluid are combined in the channel for discharge through a second discharge means.

15. The method of claim 11 wherein the shaft has a first portion adjacent the first end of the container and a second portion adjacent the second end of the container and wherein the first portion of the shaft is provided with the dispersing members for dispersing and separating the mixture adjacent the first end of the container.

16. The method of claim 11 wherein the spray means sprays water which enables the second material to flow along the container toward the side section and the first discharge means.

17. The method of claim 16 wherein a weir is located in the first side adjacent the screw means for diverting the second material away from the screw means and into the side section of the container for removal of the second material through the first discharge means.

* * * * *